US007270337B1

(12) United States Patent
Carotenuto

(10) Patent No.: US 7,270,337 B1
(45) Date of Patent: Sep. 18, 2007

(54) PIVOT PLATE APPARATUS FOR SNOWBOARDS

(76) Inventor: Robert L Carotenuto, 36 A Newport Ave., Coatesville, PA (US) 19320

( * ) Notice: Subject to any disclaimer, the term of this patent is extended or adjusted under 35 U.S.C. 154(b) by 317 days.

(21) Appl. No.: 11/004,540

(22) Filed: Dec. 3, 2004

(51) Int. Cl.
*A63C 9/02* (2006.01)

(52) U.S. Cl. ..... 280/14.24; 280/618

(58) Field of Classification Search ..... 280/14.21, 280/14.22, 14.24, 612, 613, 617, 618, 623, 280/636
See application file for complete search history.

(56) References Cited

U.S. PATENT DOCUMENTS 5,826,910 A * 10/1998 Ricks et al. ..... 280/618
6,203,051 B1 * 3/2001 Sabol ..... 280/607
6,257,614 B1 * 7/2001 Duggan ..... 280/618
6,450,511 B1 * 9/2002 LaVoy ..... 280/14.22
6,491,310 B1 * 12/2002 Work ..... 280/14.24
6,916,036 B1 * 7/2005 Egli ..... 280/618
7,090,228 B2 * 8/2006 Reynolds ..... 280/14.24
2003/0038455 A1 * 2/2003 Lett ..... 280/618

* cited by examiner

*Primary Examiner*—Frank Vanaman
(74) *Attorney, Agent, or Firm*—Michael I. Kroll

(57) ABSTRACT

Apparatus 10 for a pivotal element 20 communicating between the base plate of the binding 24 and the top of the snowboard 16 that is secured in a fixed position when riding and can be selectively released for skating and while on a lift where the snowboard would hang downward from the user's boot in a substantially parallel relation therewith.

10 Claims, 17 Drawing Sheets

PIVOT PLATE APPARATUS FOR SNOWBOARDS

BACKGROUND OF THE INVENTION

1. Field of the Invention

The present invention relates generally to snowboard bindings and, more specifically to a selectively pivotable element for snowboard bindings to provide the snowboarder with increased comfort and mobility when skating and riding lifts by allowing the user to selectively rotate the lead foot into a position substantially parallel with the board rather then the relatively perpendicular relation in which it is traditionally fixed.

Skating is the term used when a boarder releases the binding of the rear foot in order to travel uphill or on level ground and uses the rear foot to push off and the lead foot, which is still bound to the board, to glide over the snow in a manner similar to skateboarding. Unfortunately, the lead foot is fixed to its binding in an awkward position to perform such a task. Furthermore, boarders skate when in lift lines and when getting on the lift thereby resulting in the weight of the board twisting the leg of the user. This is rectified by using the free foot to lift the board and hold it in a substantially horizontal position for the duration of the ride which could be intrusive to a fellow passenger on the lift.

The present invention seeks to overcome the shortcomings inherent in snowboard bindings having fixed bindings by introducing a pivotable element communicating between the baseplate of the binding and the snowboard that is secured in a fixed position when riding and can be selectively released for skating and while on a lift where the board would hang downward from the user's boot in a substantially parallel relation therewith.

2. Description of the Prior Art

There are other snowboard binding accessories suitable for the purposes for which they were designed, they would not be as suitable for the purposes of the present invention, as hereinafter described.

SUMMARY OF THE PRESENT INVENTION

The present invention discloses a pivotal element communicating between the base plate of the binding and the top of the snowboard that is secured in a fixed position when riding and can be selectively released for skating and while on a lift where the snowboard would hang downward from the user's boot in a substantially parallel relation therewith.

A primary object of the present invention is to provide means for selectively rotating a boot binding relative to a snowboard.

Another object of the present invention is to provide a rotative member fixedly positioned between a boot binding and a snowboard.

Yet another object of the present invention is to provide a rotative member having an engagable and disengagable locking element.

Still yet another object of the present invention is to provide a rotative member wherein a boot binding can be rotated 90 degrees relative to a snowboard.

Another object of the present invention is to provide means whereby a user can easily change their boot binding position relative to a snowboard making it easier to cross relatively flat ground.

Yet another object of the present invention is to provide a rotative mechanism having spaced apart members with ball bearing positioned therebetween.

Yet another object of the present invention is to provide a device having magnetic unlocking mechanism Still yet another object of the present invention is to provide a new and novel snowboard accessory.

Additional objects of the present invention will appear as the description proceeds.

The present invention overcomes the shortcomings of the prior art by providing a binding which is normally fastened to a snowboard by several fasteners preventing any movement between the two and able to be selectively rotated by incorporating a rotative mechanism between the normally secured components and adding a locking mechanism which allows the user to lock the binding to the board while riding or releasing the binding to rotate while still being secured to the board. In essence, there are two highly desirable positions for a user's feet while using a snowboard. One is to secure the feet in a perpendicular direction relative to the board while riding. The other is to place the lead foot parallel to the board while skating and riding lifts.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
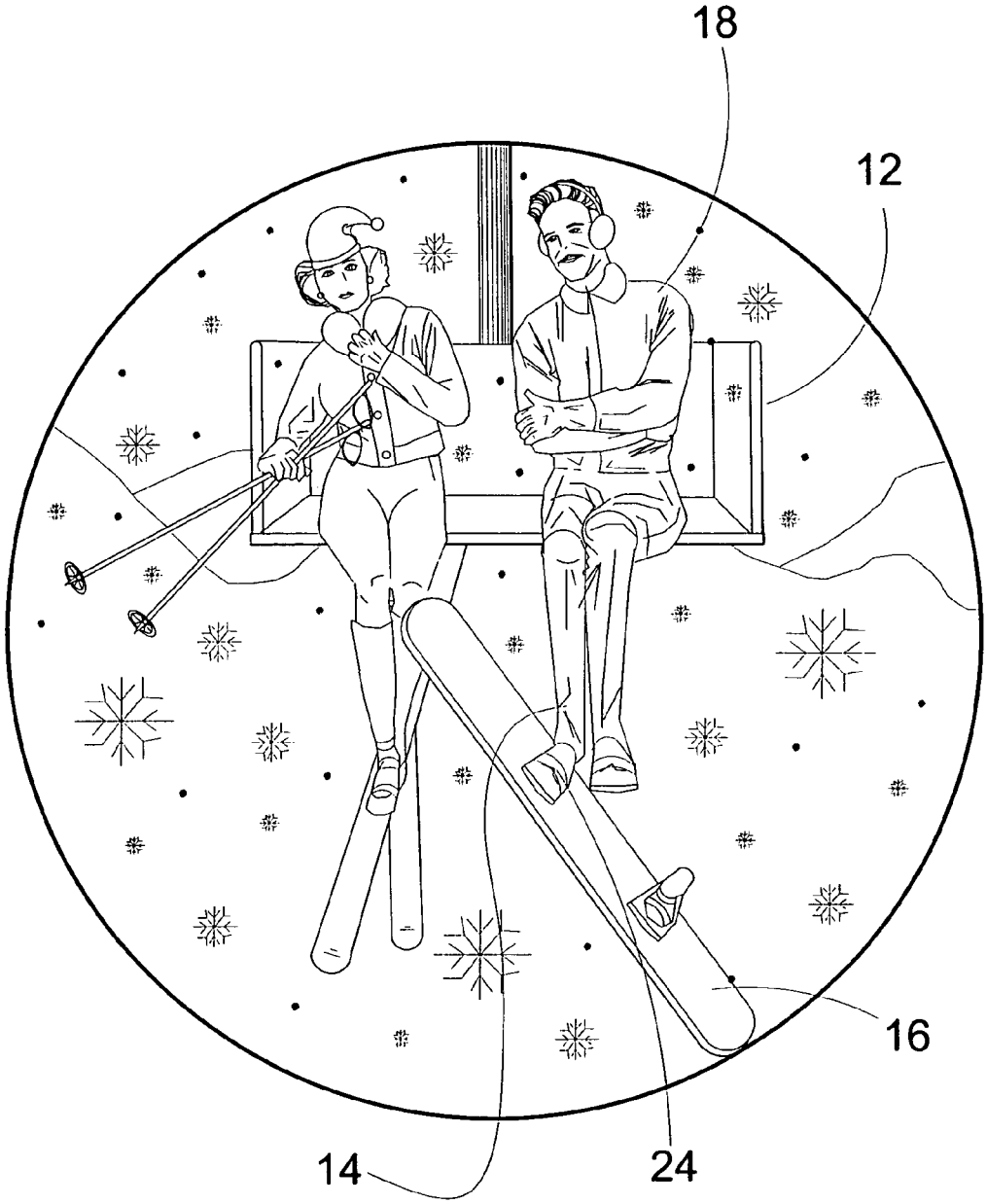
FIG. 1 ( PRIOR ART )
FIG. 1 is an illustrative view of prior art.

With regard to reference numerals used, the following numbering is used throughout the drawings.

10 present invention
12 ski lift
14 foot
16 snowboard
18 user
20 pivot element
22 flat surface
24 binding
28 locking mechanism
30 boot
32 securing plate
34 mounting screw
36 lock
37 shaft
38 bottom plate
39 side wall
40 pivot plate
41 recess
42 top ring
43 overhang portion
44 screws
46 bearing
47 race
48 top plate/snow guard
49 side wall
50 lock
52 set screw
54 threaded insert
56 pivot stop nub
58 screw
60 mounting holes
62 washer
64 arrow
66 top plate
67 bottom plate
68 nut
69 seated bearing
70 top rotating bearing
72 mounting hole
74 threaded lug
76 pins
78 spring
79 first housing
80 second magnetic housing
82 aperture
84 magnetic element
86 slots
88 springs
90 unlocked
92 locked
94 lock
96 clip
98 spring

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of prior art. Boarding a ski lift 12 while having one foot 14 in the binding 24 of a snowboard 16 can cause considerable problems for the wearer and other people on the lift seat. The snowboard user 18 must prop up the snowboard with their back foot to avoid clashing with another skier's ski. Maintaining this position can be extremely uncomfortable for any prolonged period of time. The present invention is a pivoting element for snowboards that overcomes the short comings of the prior art by providing a unique pivoting element that upon release of a lock, the foot and binding will pivot, allowing the snowboard to be positioned in a forward direction so that the board will not interfere with other people's skis.

Figure 2:
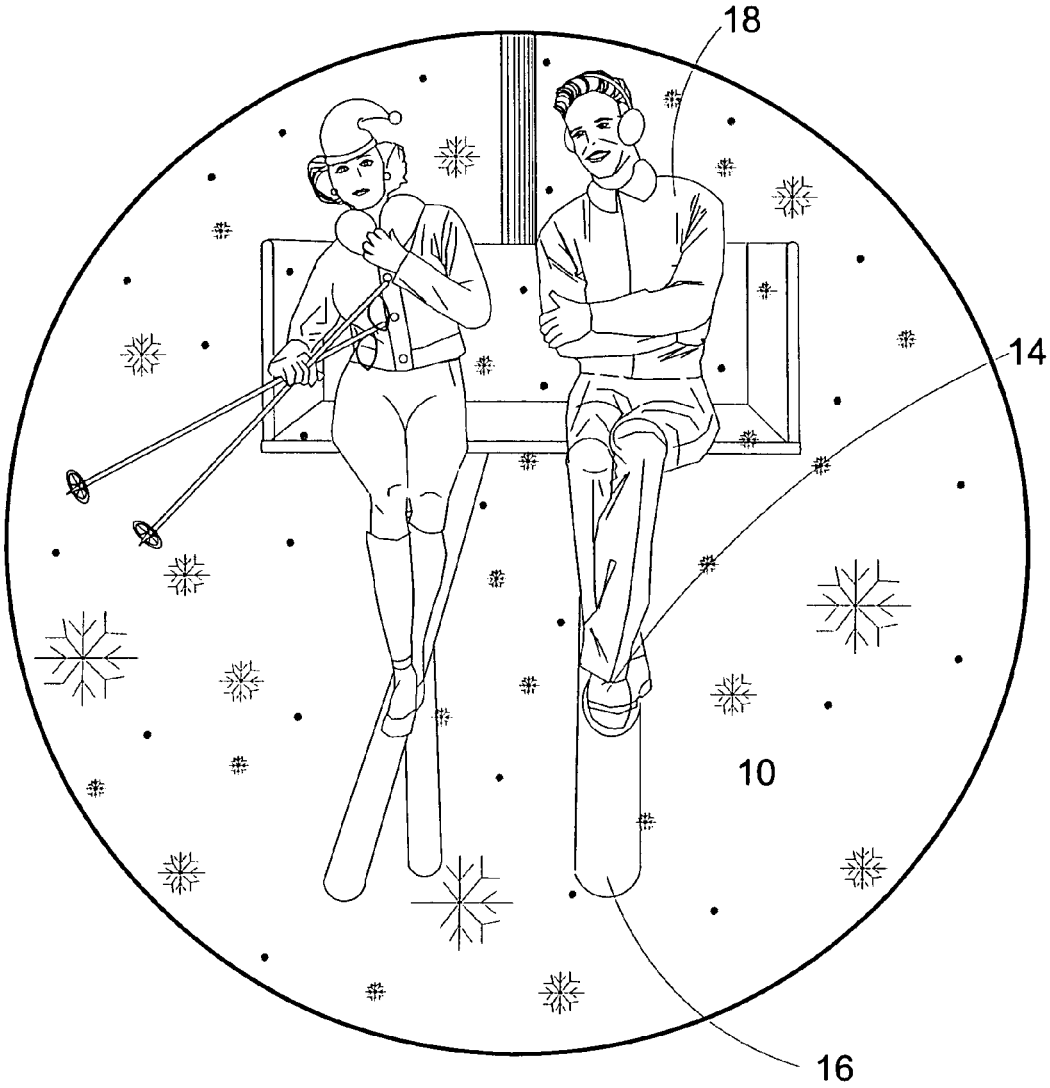
FIG. 2 is an illustrative view of the pivot element of the present invention in use.

Turning to FIG. 2, shown therein is an illustrative view of the pivot element of the present invention 10 in use. The present invention 10 has a pivoting element for snowboards 16 that upon release of a locking mechanism allows the binding to rotate whereby a user 18 can rotate their foot 14 in a forward direction preventing the board from contacting other people's skis.

Figure 3:
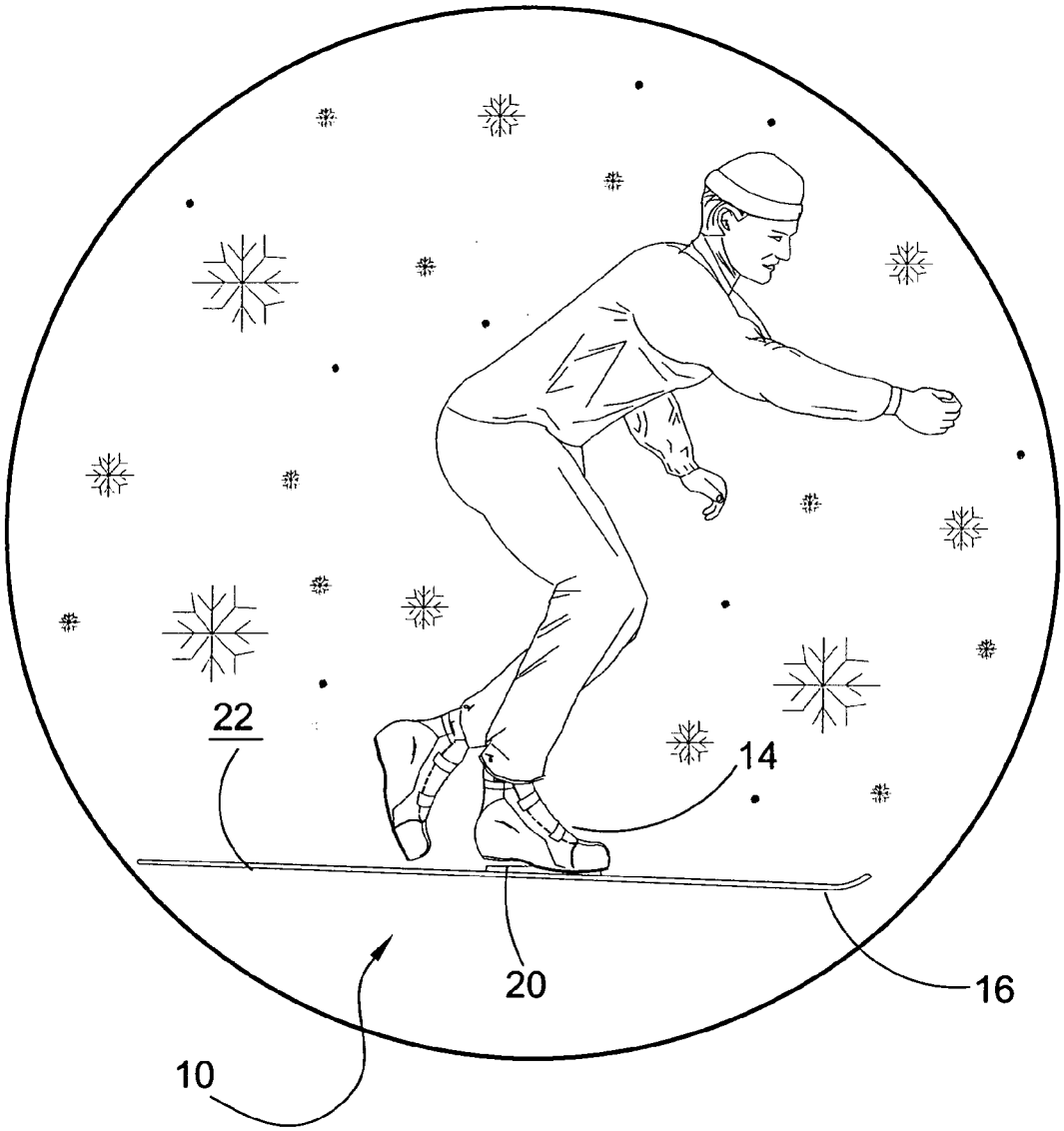
FIG. 3 is an illustrative view of the pivot element of the present invention in use.

Turning to FIG. 3, shown therein is an illustrative view of the pivot element 20 of the present invention 10 in use. Shown is the snowboard 10 pivoting element 20 in use on a substantially flat surface 22. The present invention 10 provides means whereby a user 18 when faced with having to propel himself using the snowboard 16 can release a lock mechanism that allows the binding to be rotated. Therefore the foot 14 can be moved to a more natural parallel position on the board 16 as opposed to the perpendicular position used for riding the board on an incline. The binding release mechanism can be under some tensioning mechanism whereby if the foot 14 is rotated to an operative perpendicular direction the lock mechanism will engage the binding providing the user 18 means to continue a descent without having to stop to engage the locking mechanism.

Figure 4:
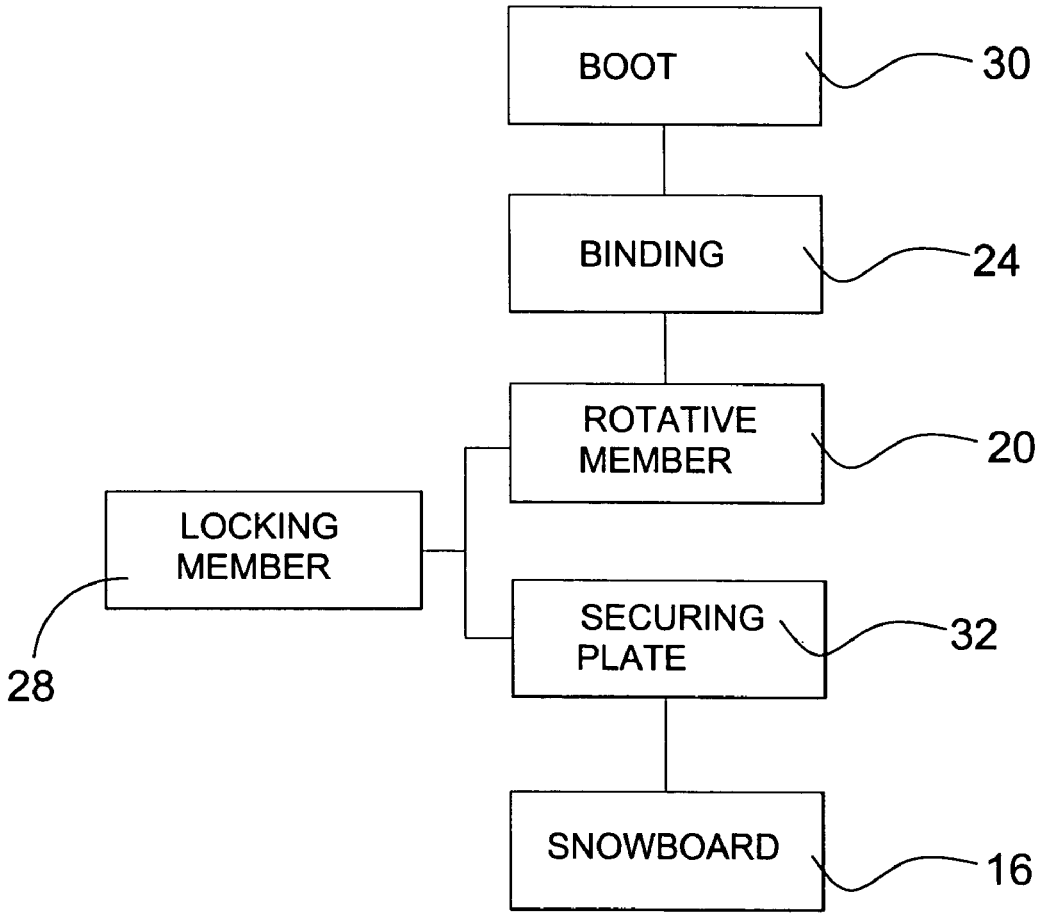
FIG. 4 is a diagrammatic view of the pivot element of the present invention.

Turning to FIG. 4, shown therein is a diagrammatic view of the pivot element of the present invention. Shown is the method of the present invention whereby a boot 30 in binding 24 which is normally fastened to a snowboard by several fasteners preventing any movement between the two is able to be selectively rotated by incorporating a rotative mechanism 20 with securing plate 32 between the normally secured components and adding a locking mechanism 28 which allows the user to lock the binding(s) to the board 16 while accelerating down a mountain or releasing the binding to rotate while still being secured to the board. In essence, there are two highly desirable positions for a user's feet while using a snowboard 16. One is to secure the feet in a perpendicular direction relative to the board 16 while accelerating down a mountain. The other is to place the foot parallel to the board 16 while having to propel himself with the other foot.

Figure 5:
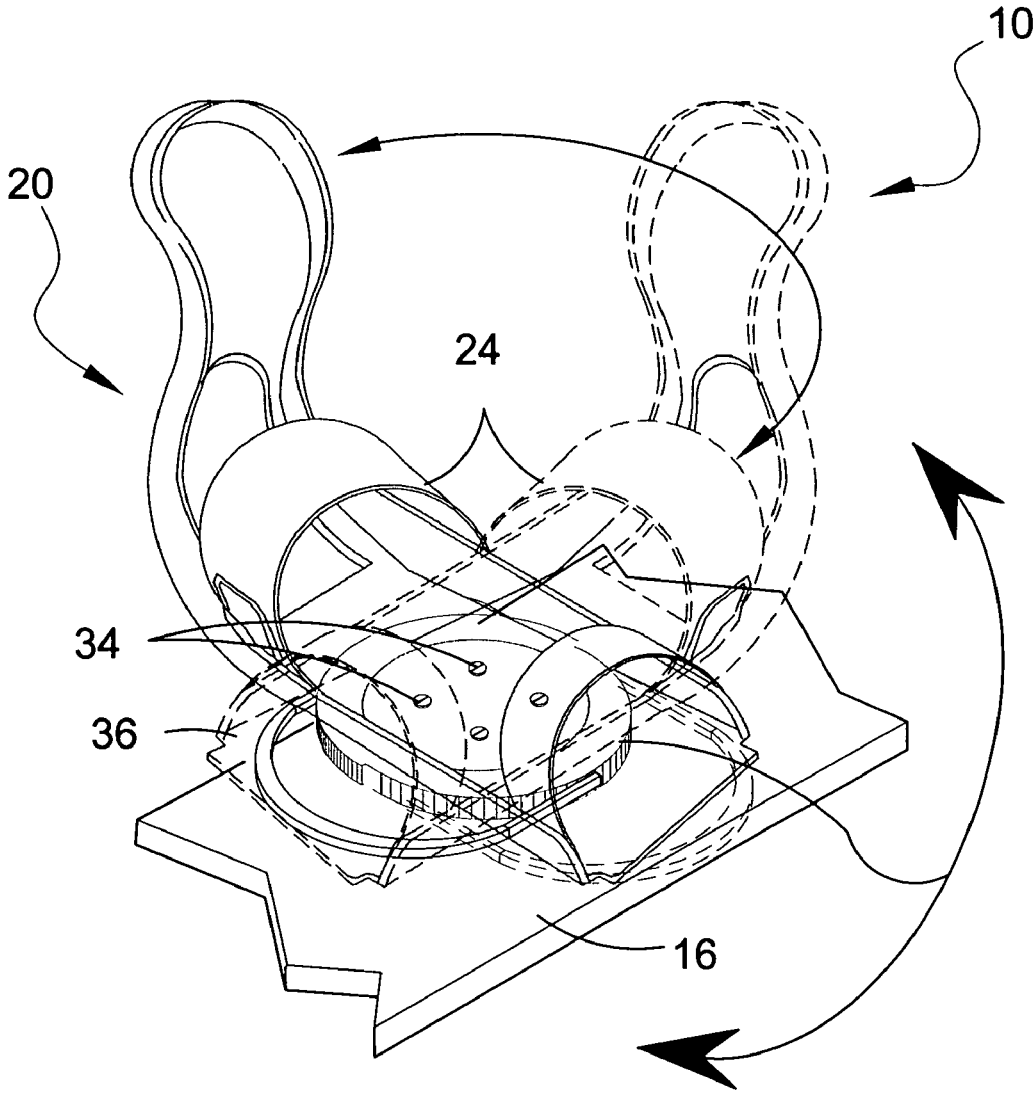
FIG. 5 is an enlarged view of the rotation of the pivot element of the present invention.

Turning to FIG. 5, shown therein is an enlarged view of the rotation of the pivot element 20 of the present invention 10. Shown is the present invention 10 positioned between a snowboard 16 and a binding 24 whereby a binding which is normally fastened to a snowboard by several fasteners preventing any movement is able to be selectively rotated by incorporating the rotative mechanism 20 of the present invention between the normally static binding and snowboard. The rotative mechanism 20 is comprised of a top plate for securing the binding thereto and a bottom plate which is secured to the snowboard 16. Positioned between the top and bottom plate is a support that reduces the friction during motion of the top plate relative to the bottom plate. There can also be a locking mechanism engaging the plates to prevent rotational motion, which can be selectively disengaged allowing rotational motion of one plate to the other. Also shown are mounting screw 34 and lock 36.

Figure 6:
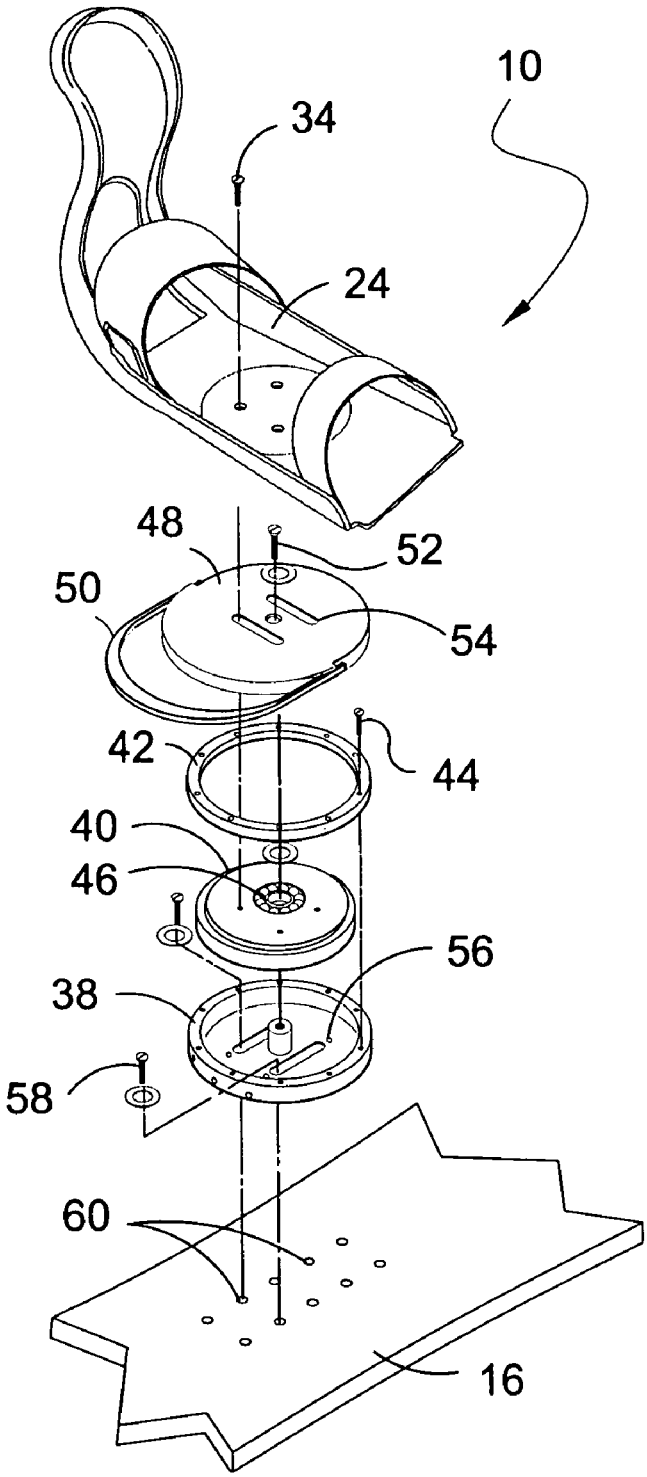
FIG. 6 is an exploded view of the pivot element of the present invention.

Turning to FIG. 6, shown therein is an exploded view of the pivot element of the present invention. Shown is an exploded view of the present invention 10 positioned between a snowboard 16 and a binding 24. The rotative mechanism is comprised of a top plate 48 for securing the binding 24 thereto with screws 34 and a bottom plate 38 which is secured to the snowboard 16. The pivot plate or disk 40 is retained within the bottom plate 38 by a top ring 42 which is fastened with screws 44 to the bottom plate once the pivot plate is positioned within. Positioned between the top 48 and bottom plate 38 is a bearing 46 that reduces the friction during motion of the top plate relative to the bottom plate. Also shown are lock 50, set screw 52, threaded insert 54, pivot top nub 56, screw 58 and mounting holes 60.

Figure 7:
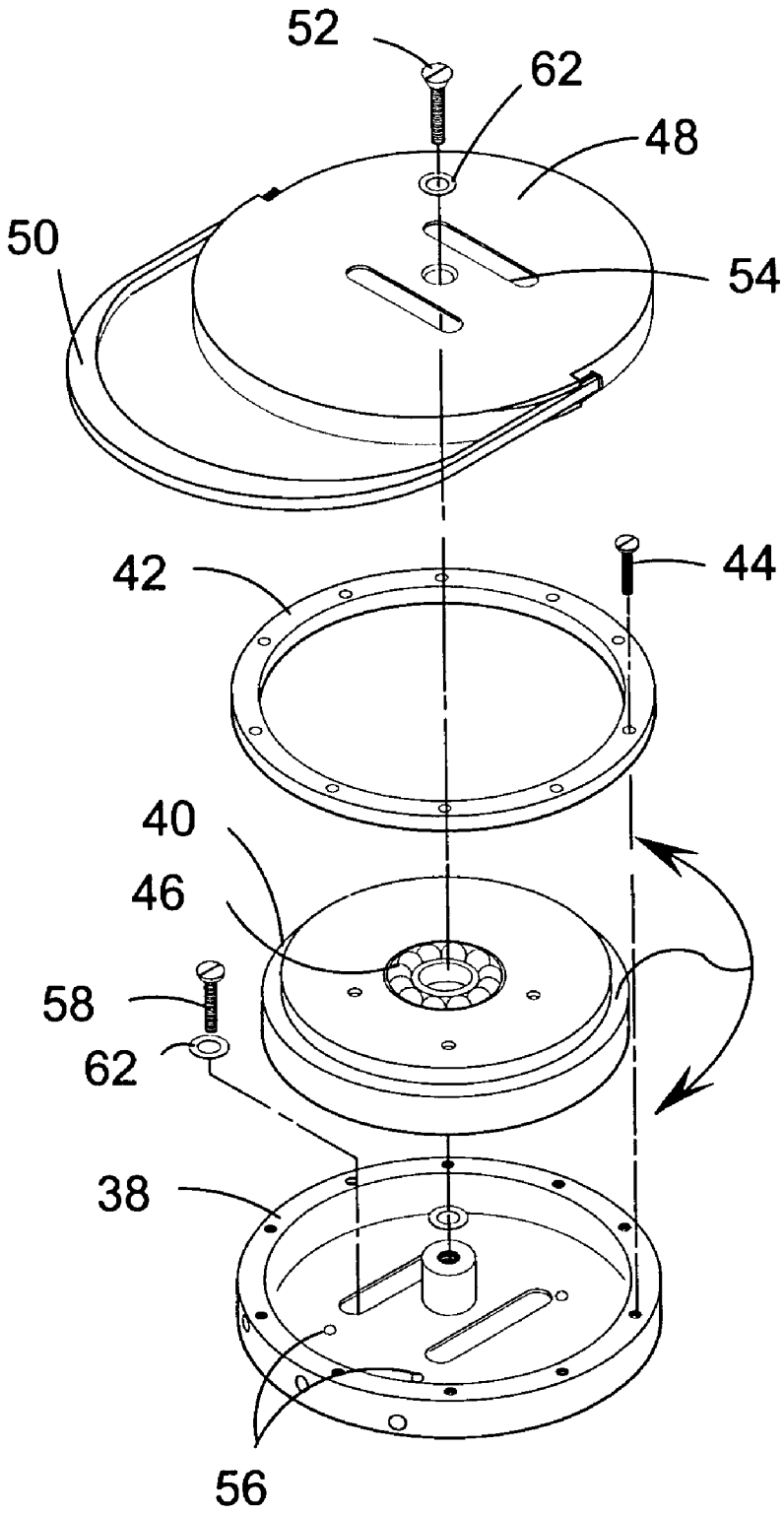
FIG. 7 is an exploded view of a pivot element of the present invention.

Turning to FIG. 7, shown therein is an exploded view of a pivot element of the present invention. Shown is an exploded view of the present invention. The rotative mechanism has a bottom plate 38 with a plurality of apertures in the base for securing the bottom plate to a snowboard. The pivot plate 40 is retained within the bottom plate 38 by the top ring 42 which is fixed to the bottom plate by fasteners 44. The top plate 48 is threadedly fastened with screw 52 to the bottom plate 38. Positioned between the top 48 and bottom plate 38 is a bearing 46 that reduces the friction during motion of the top plate relative to the bottom plate. Also shown are lock 50, threaded insert 54, pivot top nub 56, and screw 58. Also shown are washers 62. Top plate 48 also serves as a snow guard to protect the inner parts of the present invention.

Figure 8:
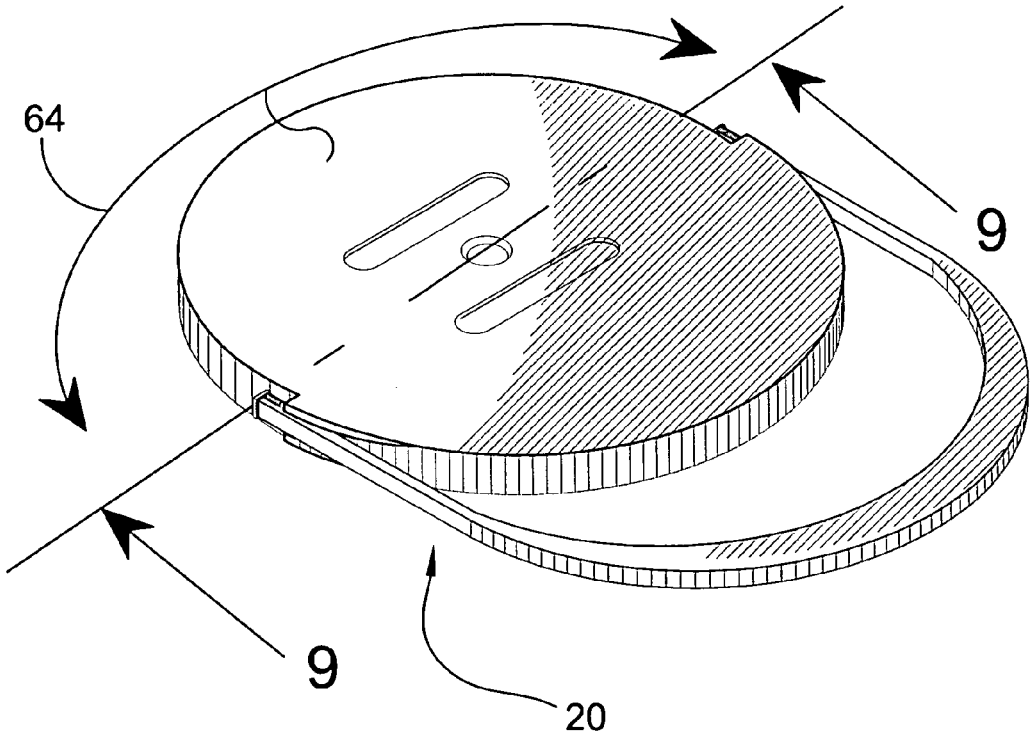
FIG. 8 is a perspective view of a pivot element of the present invention.

Turning to FIG. 8, shown therein is a perspective view of a pivot element 20 of the present invention. Shown is a pivoting element 20 for snowboards having a unique means for fixing the binding(s) in a substantially perpendicular position relative to the board or selectively releasing the binding to move as shown by arrow 64 into a parallel position relative the snowboard. The device is comprised of two plate-like elements that are fastened to each other by a centrally positioned spindle. A tensioned locking member holds the plates from independent movement until the user disengaging the locking release mechanism allowing for movement of one plate relative the other. When the binding is moved back to its pre-rotative position the locking mechanism will re-engage preventing rotative movement.

Figure 9:
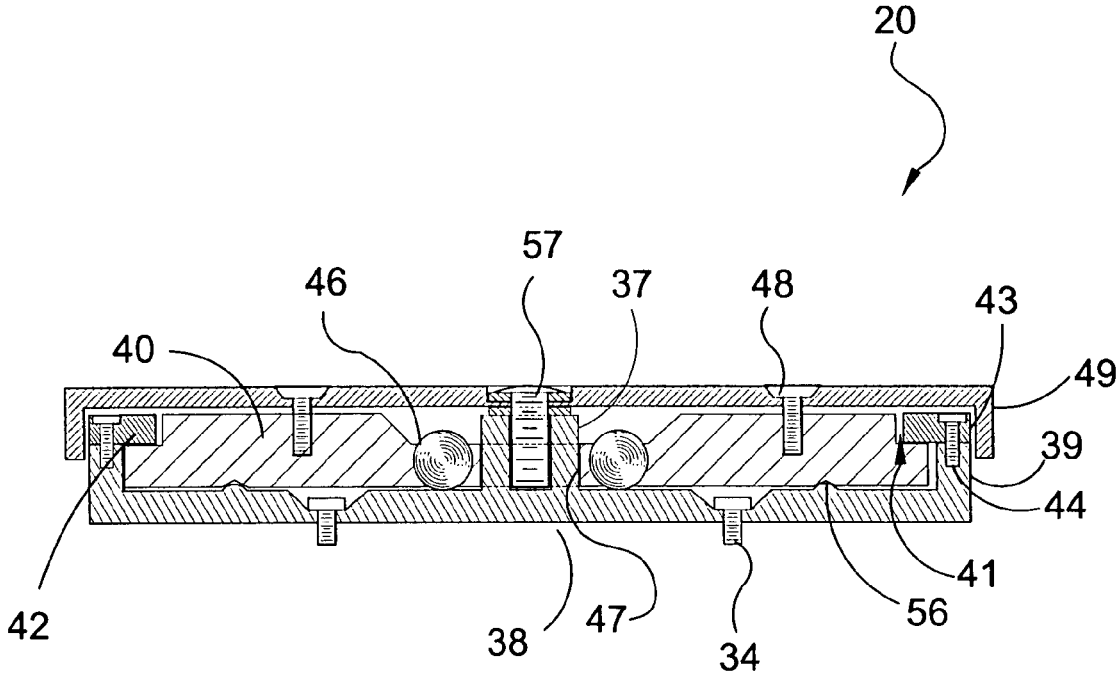
FIG. 9 is a sectional view of the pivot element of the present invention.

Turning to FIG. 9, shown therein is a sectional view of the pivot element 20 of the present invention. Shown is a cross sectional view of the rotative mechanism 20, taken from FIG. 8 as indicated. The rotative mechanism 20 is comprised of a bottom plate 38 which is secured to the snowboard by fasteners 34. Positioned within the bottom plate 38 having side wall 39 is the pivot plate 40 which slides against and is retained at recess 41 therein by the top ring 42 having overhang portion 43 which is fixed to the bottom plate by fasteners 44. The top plate 48 has side wall 49 and is threadedly fastened with screw 52 to the bottom plate 38 and serves as means for attaching the binding having a plurality of threaded apertures. Positioned between the top 48 and bottom plate 38 is a bearing 46 in a race 47 on shaft 37 that reduces the friction during motion of the top plate 48 relative to the bottom plate 38. There can also be a locking mechanism, not shown, that is pivotally fastened to the exterior of the top plate 48 having posts extending through an aperture in the bottom plate 38 and extending into the pivot plate. Also shown is pivot stop nub 56 and mating recess.

Figure 10:
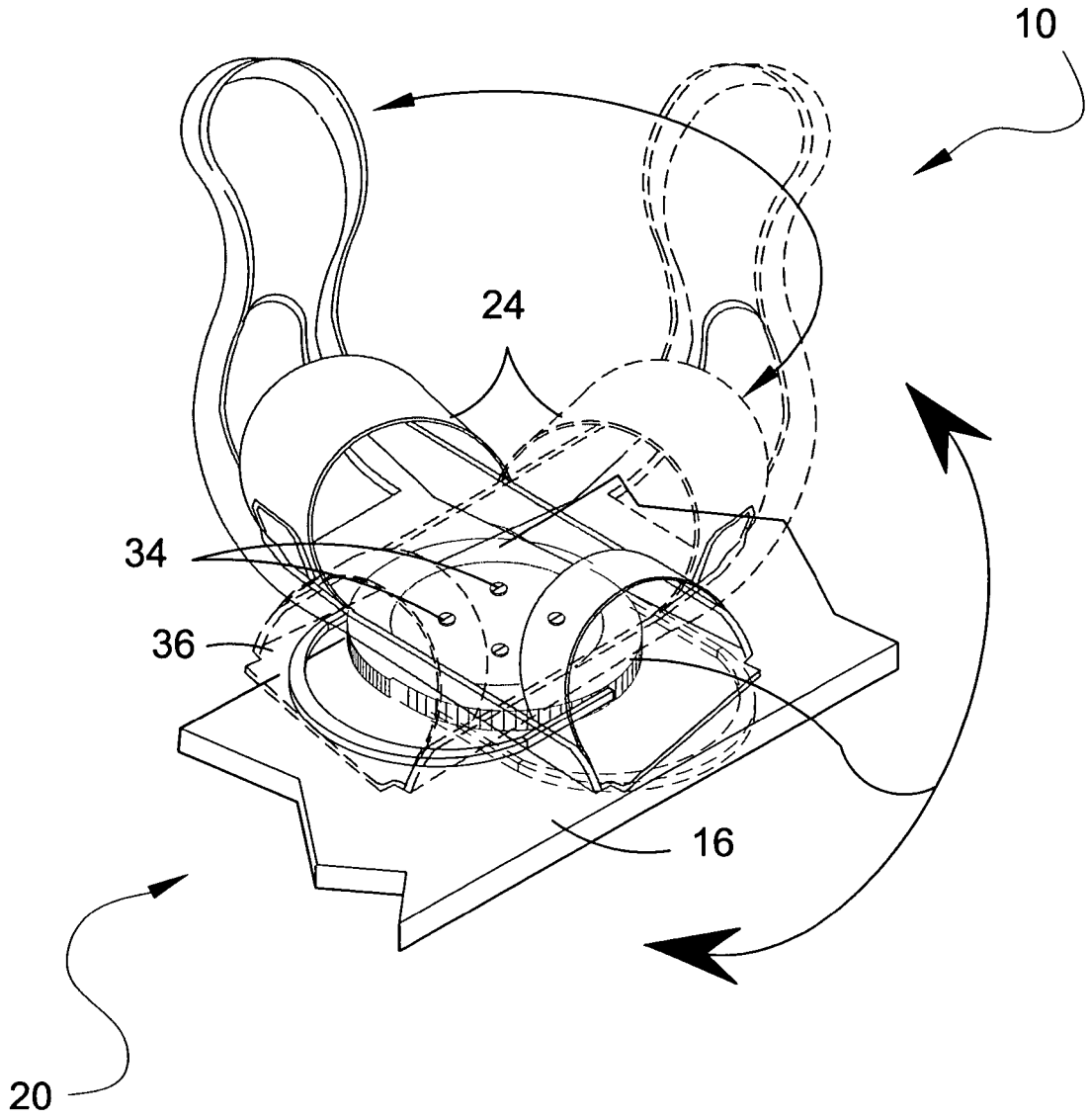
FIG. 10 is an enlarged view of the rotation of the pivot element of the present invention.

Turning to FIG. 10, shown therein is an enlarged view of the rotation of the pivot element 20 of the present invention 10 on board 16. Shown is the rotation mechanism 20 of the present invention 10 wherein the locking mechanism engages the top plate and the bottom plate. To selectively rotate the binding 24 which is fastened to the top plate, pressure is applied to the free distal end of the lock 36 which will pivot on its pivot point retracting from its seated position within the top and bottom plate apertures thereby providing for rotative motion. To re-engage the locking mechanism is accomplished by rotating the binding 24 until the lock mechanism seats within the bottom plate lock aperture which will occur due to tensional forces continuously applied to the lock mechanism.

Figure 11:
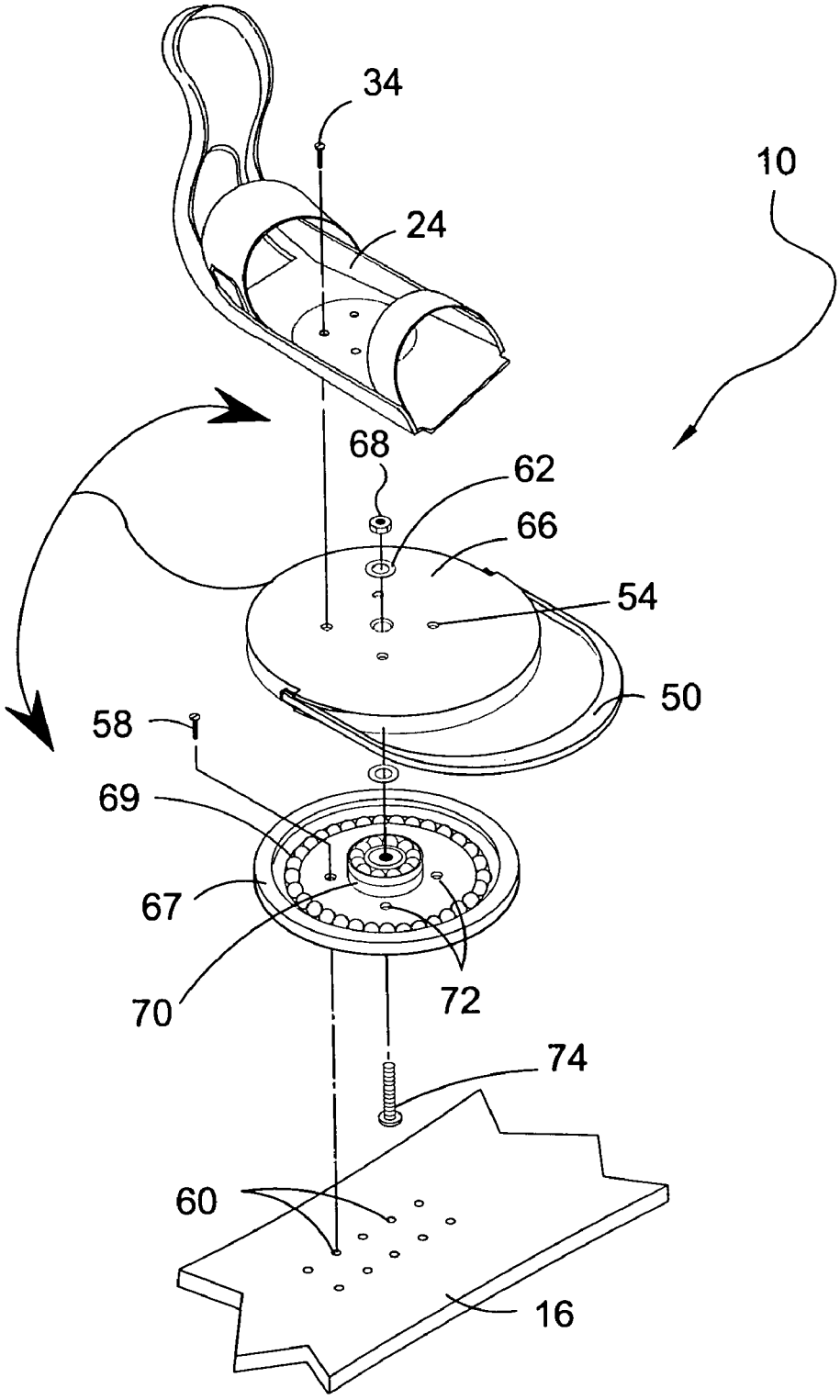
FIG. 11 is an exploded view of the pivot element of the present invention.

Turning to FIG. 11, shown therein is an exploded view of the pivot element of the present invention 10. Shown is a variation of the present invention 10 disclosing a pivoting element for snowboards comprising a pivoting plate capable of full rotation and having ball bearing sleeves, manual lock, top plate 66 for the mounting of binders 24 and a bottom plate 67 for mounting to snowboard 16. Also shown is mounting screw 34, nut 68 with washer 62, threaded insert 54, lock 50, seated bearing 69, screw 58, top rotating bearing 70, mounting holes 60, mounting hole 72, and thread lug (axle) 74.

Figure 12:
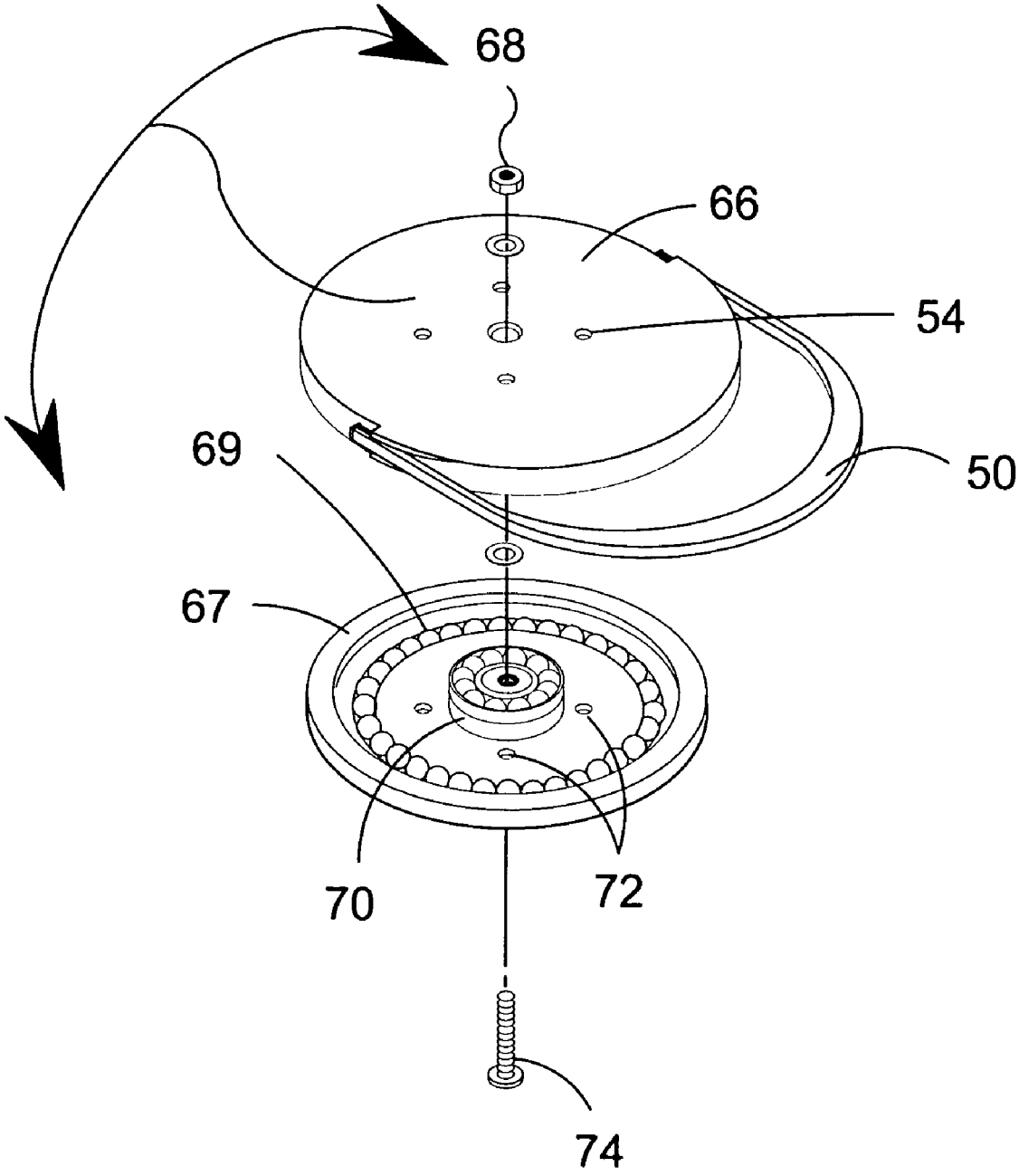
FIG. 12 is an exploded view of the pivot element of the present invention.

Turning to FIG. 12, shown therein is an exploded view of the pivot element of the present invention. Shown is an exploded view of another mechanism whereby the binding (s) of a snowboard can be rotated. Upon release of a lock 50, the foot and binding will pivot, allowing the snowboard to be positioned in a forward direction. The device also allows the user to easily push the snowboard across a flat surface similar to a skate board. The device of the present invention comprises a pivoting plate 66 capable of full rotation and having ball bearing sleeves, manual latch, top plate 66 for the mounting of binding(s) and a bottom plate 67 for mounting to snowboard. Other previously disclosed elements are also shown.

Figure 13:
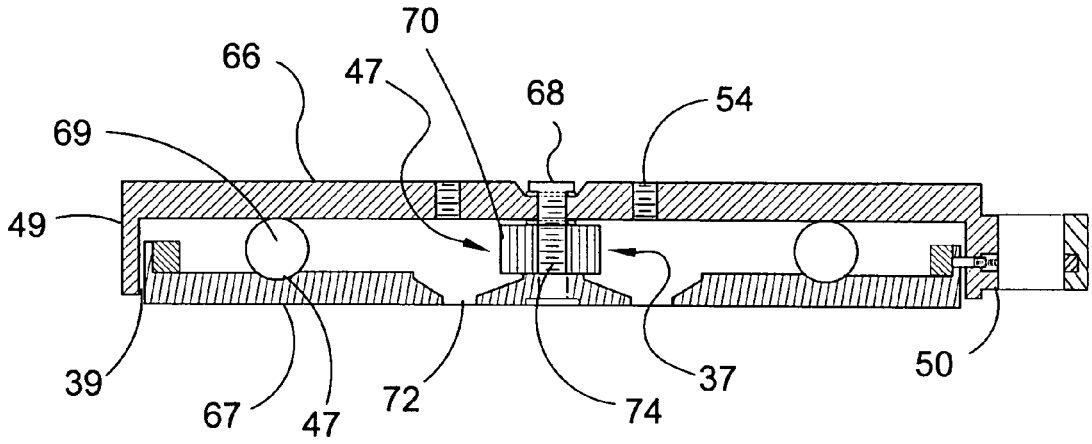
FIG. 13 is a sectional view of the pivot element of the present invention.

Turning to FIG. 13, shown therein is a sectional view of the pivot element of the present invention. Shown is a sectional view of the variation of the present invention disclosing a pivoting element for snowboards provides a unique pivoting element that upon release of a lock, the foot and binding will pivot, allowing the snowboard to be positioned in a forward direction. The device provides means whereby a user can rotate the binding(s) while still attached to the board and propel themselves across snow covered ground. The device of the present invention comprises a pivoting plate capable of full rotation and having ball bearing sleeves, lock, top plate 66 for the mounting of binding(s) and a bottom plate 67 for mounting to snowboard. Other previously disclosed elements are also shown.

Figure 14:
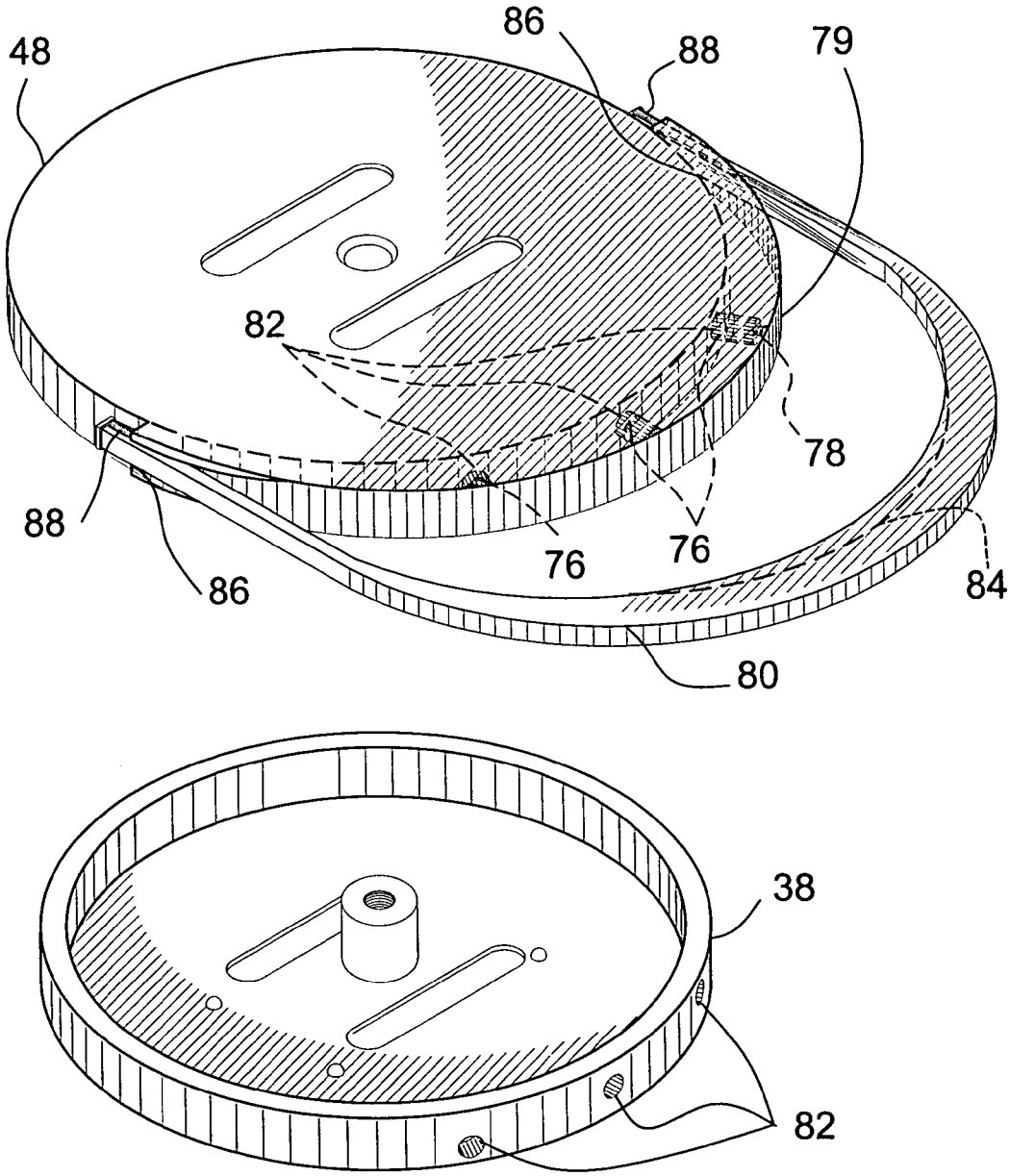
FIG. 14 is a perspective view of the lock element of the present invention.

Turning to FIG. 14, shown therein is a perspective view of the lock element of the present invention. Shown is the locking element comprising a plurality of magnetic pins 76 in a first u-shaped housing 79 having springs 78 thereon with a mating second u-shaped magnetic housing 80 having springs 88 thereto. The magnetic pins 76 and the magnetic element 84 are configured to present opposing magnetic forces to one another thereby repelling the magnetic pins 76 into their respective apertures 82 or releasing according to the position of the magnetic housing 80 with regard to the snow guard. Also shown are bottom plate 38, snow guard or top plate 48, slots 86 and springs 88.

Figure 15:
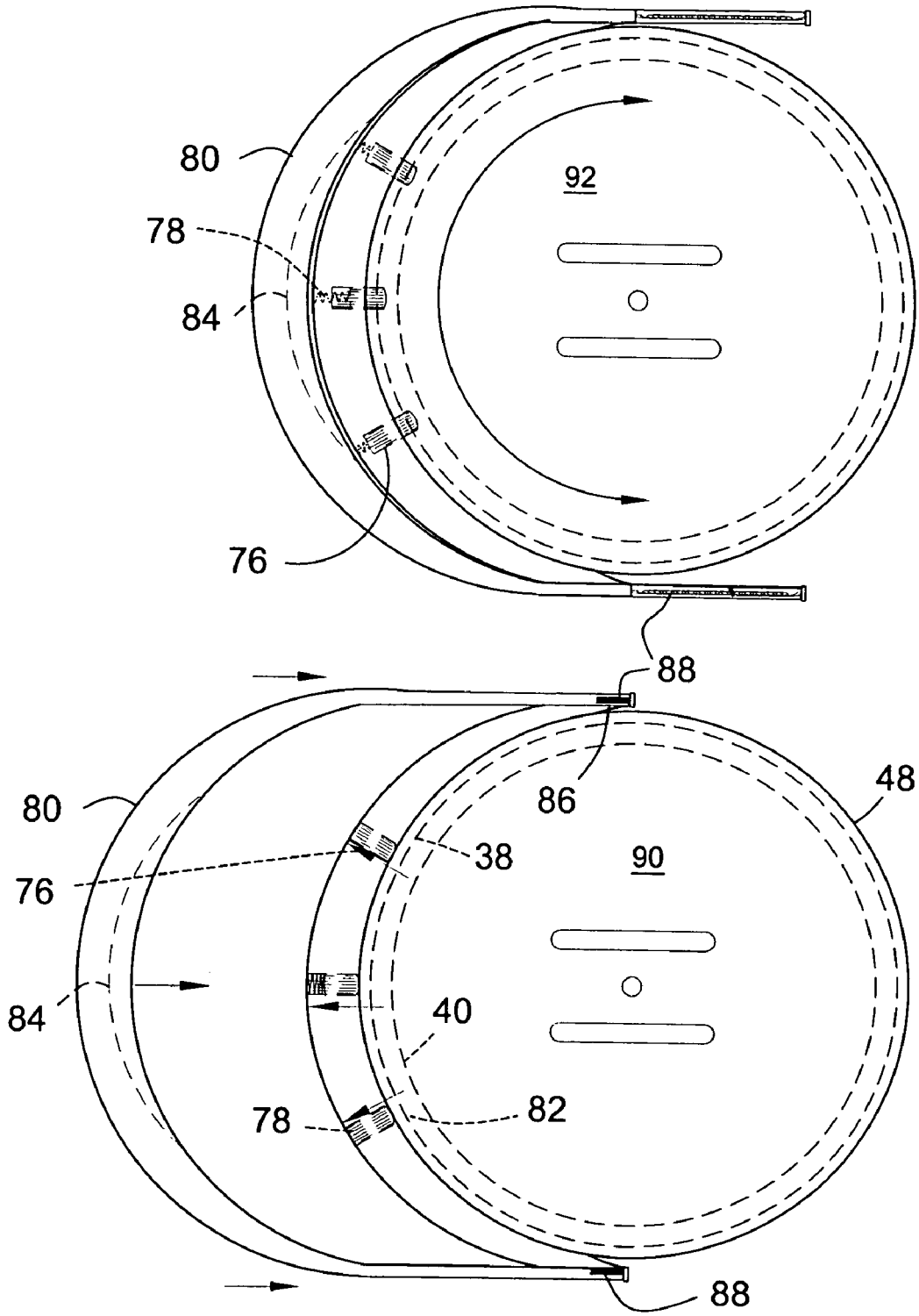
FIG. 15 is an illustrative top view of the lock element of the present invention.

Turning to FIG. 15, shown therein is an illustrative top view of the lock element of the present invention. Shown is the lock element in the unlocked at 90 and locked at 92 position wherein magnetic pins 76 have interior spring members 78 that have a natural tendency to provide a bias to pull the pins from the apertures 82 and unlock the device when the magnetic housing 80 with magnetic element 84 is in the extended position. Closing the gap between the magnetic housing 80 and the top plate or snow guard 48 locks the device when the opposing magnetic forces of the magnetic element 84 and the magnetic pins 76 overcome the bias presented by the springs 78 and urge the pins into their respective apertures 82. Other elements previously shown are also disclosed.

Figure 16:
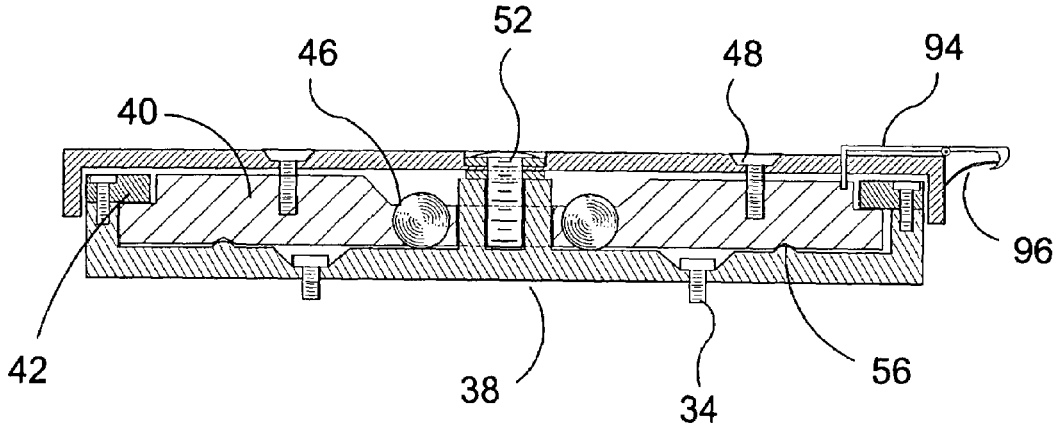
FIG. 16 is a sectional view of an alternate of the pivot element of the present invention.

Turning to FIG. 16, shown therein is a sectional view of an alternate of the pivot element of the present invention. Shown is a sectional view of the rotative mechanism. The rotative mechanism is comprised of a bottom plate 38, which is secured to the snowboard by fasteners 34. Positioned within the bottom plate 38 is the pivot plate 40 which is retained therein by the top ring 42, which is fixed to the bottom plate by fasteners. The top plate 48 is threadedly fastened at 52 to the bottom plate 38 and serves as means for attaching the binding having a plurality of threaded apertures. Positioned between the bottom 38 and top plate 48 is a bearing 46 that reduces the friction during motion of the top plate relative to the bottom plate. There can also be a locking mechanism 94 that is pivotally fastened to the exterior of the top plate 48 having posts extending through an aperture in the bottom plate and extending into the pivot plate along with a metal spring clip 96. Other elements previously disclosed are also shown.

Figure 17:
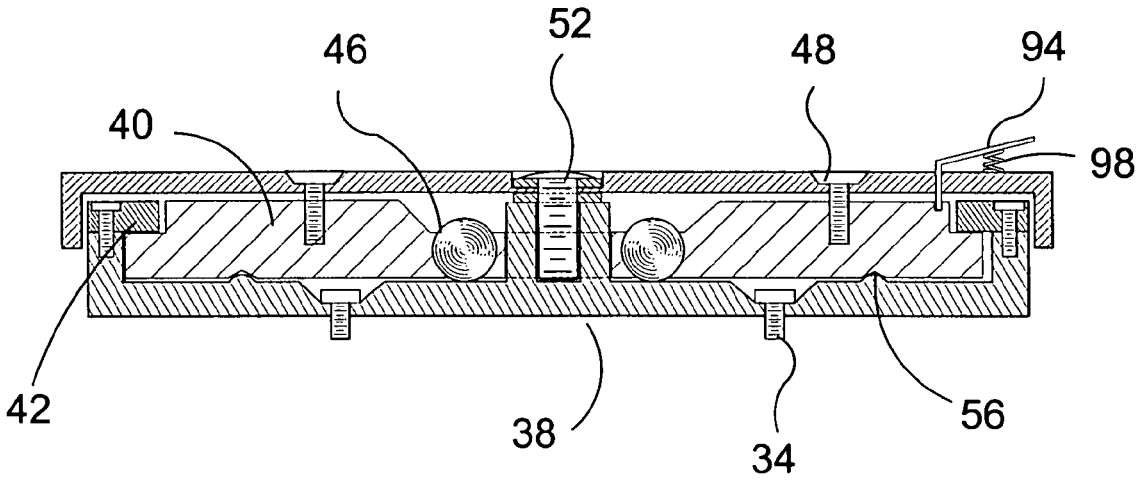
FIG. 17 is a sectional view of an alternate of the pivot element of the present invention.

Turning to FIG. 17, shown therein is a sectional view of an alternate of the pivot element of the present invention. Shown is a sectional view of the rotative mechanism. The rotative mechanism is comprised of a bottom plate 38, which is secured to the snowboard by fasteners 34. Positioned within the bottom plate 38 is the pivot plate 40 which is retained therein by the top ring 42, which is fixed to the bottom plate by fasteners. The top plate 48 is threadedly fastened at 52 to the bottom plate 38 and serves as means for attaching the binding having a plurality of threaded apertures. Positioned between the bottom 38 and top plate 48 is a bearing 46 that reduces the friction during motion of the top plate relative to the bottom plate. There can also be a locking mechanism 94 that is pivotally fastened to the exterior of the top plate 48 having posts extending through an aperture in the bottom plate and extending into the pivot plate along with a spring 98. Other elements previously disclosed are also shown.

I claim:

1. An apparatus for providing a pivoting member for attachment of a binding to the top surface of a snowboard, comprising:

a) a bottom plate having top and bottom surfaces and a peripheral edge, wherein said bottom plate is adapted for mounting onto the top surface of the snowboard so that said bottom surface of said bottom plate is contiguous to the top surface of the snowboard;

b) a top plate having top and bottom surfaces and a peripheral edge, wherein said top plate is adapted for rotatable connection to said bottom plate so that said bottom surface of said top plate is oriented toward said top surface of said bottom plate, wherein said top plate is adapted for having the binding of the snowboard connected thereto;

c) a pivot disk having top and bottom surfaces and a peripheral edge, wherein said pivot disk is adapted for rotatable mounting between said top surface of said bottom plate and said bottom surface of said top plate wherein said top plate is connected to said pivot disk, so that said pivot disk and said top plate rotate together so that a foot of a user is perpendicular to the snowboard in a first foot position and parallel to the snowboard in a second foot position; and, d) means for locking said top plate whereby the top plate can be locked in said first or said second position and then released from said first or said second position and rotated to the other position;

e) a top ring being disposed on said top surface of said peripheral edge of said pivot disk, said ring having top and bottom surfaces, wherein an overhang portion of said top ring extends beyond said peripheral edge of said pivot disk so that a bottom surface of said overhang portion is contiguous to said top portion of said peripheral edge of said bottom plate, wherein said overhang portion of said top ring is fastened to said peripheral edge of said bottom plate so that said top ring and said pivot disk are secured to said bottom plate;

f) wherein said bottom plate has a centrally disposed shaft extending away from said top surface thereof toward said top plate, wherein said shaft has central female threads for receiving a mating male threaded fastener, wherein said shaft forms a race for a set of ball bearings, wherein said peripheral edge of said bottom plate forms a side wall extending upwards around said bottom plate, said side wall extending toward said top plate and having a top end thereon, wherein said bottom plate has a plurality of first holes therein, wherein fasteners extend through said first holes into the top surface of the snowboard so that said bottom plate is attached to the snowboard;

g) wherein said peripheral edge of said top plate forms a side wall extending downwardly around said top plate, said side wall extending toward said bottom plate and having a bottom end thereon, wherein said top plate has a central second hole therein, wherein a threaded fastener extends through said second hole into said female threads of said shaft on said bottom plate so that said top plate is rotatably connected to said bottom plate, wherein said top plate has a plurality of third holes therein, wherein fasteners extend through said third holes into said top surface of said pivot disk so that said top plate is attached to said pivot disk.

2. The apparatus of claim 1, further comprising ball bearings being centrally disposed on said pivot disk so that said shaft on said bottom plate serves as the race for said ball bearings so that said pivot disk is rotatably disposed on said shaft of said bottom plate, wherein said peripheral edge of said disk has a recess thereon so that said top ring is slidingly disposed within said recess to permit the pivot disk to be secured to the bottom plate.

3. The apparatus of claim 2, wherein said means for locking said top plate, comprises:

a) a first U-shaped housing disposed partially around the outside surface of said top plate, said first housing having a plurality of horizontal pin apertures therein, each of said pin apertures having a magnetized pin slidably disposed therein having a spring thereon each said pin so as to bias each said pin inwardly into said pin aperture;

b) said side wall of said top plate having a plurality of first horizontal apertures therein so that each said first aperture may receive one said pin therein when said first aperture is co-aligned with said pin aperture;

c) said sidewall of said bottom plate having a plurality of second horizontal apertures therein so that each said second aperture may receive one said pin therein when said first aperture is co-aligned with said pin aperture so that said bottom plate is locked to said top plate when said pins co-align with and extend through said first and second apertures; and, d) a second U-shaped housing disposed in a horizontally sliding relationship with said first U-shaped housing so that said second U-shaped housing can slide toward said first U-shaped housing in a first position and away from said first U-shaped housing in a second position, wherein said second U-shaped housing is spring-loaded to be biased toward said first position, wherein said second U-shaped housing comprises a magnetized member having an opposite magnetic polarity to said magnetized pins, so that said pins are repelled into said first and second apertures when said second U-shaped housing is moved to said first position and said pins are spring-biased back into said pin apertures when said second U-shaped housing is moved to said second position to permit the top plate to be locked into a first or second position.

4. The apparatus of claim 3, wherein said means for locking said top plate further comprises at least one pivot stop nub disposed on said top surface of said bottom plate for mating to at least one mating pivot stop nub recess disposed on said bottom surface of said pivot disk to permit the top plate to be locked in a first or second position.

5. The apparatus of claim 4, wherein said means for locking said top plate further comprises a locking mechanism pivotally fastened to the exterior of said top plate, said locking mechanism having at least one post extending through an aperture in said bottom plate and into said pivot plate, said locking mechanism having a spring disposed thereon to permit the top plate to be locked.

6. An apparatus for providing a pivoting member for attachment of a binding to the top surface of a snowboard, comprising:

a) a bottom plate having top and bottom surfaces and a peripheral edge, wherein said bottom plate is adapted for mounting onto the top surface of the snowboard so that said bottom surface of said bottom plate is contiguous to the top surface of the snowboard;

b) a top plate having top and bottom surfaces and a peripheral edge, wherein said top plate is adapted for rotatable connection to said bottom plate so that said bottom surface of said top plate is oriented toward said top surface of said bottom plate, wherein said top plate is adapted for having the binding of the snowboard connected thereto;

c) means for locking said top plate whereby the top plate can be locked in a first top plate position or a second top plate position and then released from said first or said second position and rotated to the other position;

d) wherein said bottom plate has a centrally disposed shaft extending away from said top surface thereof toward said top plate, wherein said shaft has central female threads for receiving a mating male threaded fastener, wherein said shaft forms a race for a set of ball bearings, wherein said peripheral edge of said bottom plate forms a side wall extending upwardly around said bottom plate, said side wall extending toward said top plate and having a top end thereon, wherein said bottom plate has a plurality of first holes therein, wherein fasteners extend through said first holes into the top surface of the snowboard so that said bottom plate is attached to the snowboard; and wherein said peripheral edge of said top plate forms a side wall extending downwardly around said top plate, said side wall extending toward said bottom plate and having a bottom end thereon, wherein said top plate has a central second hole therein, wherein a threaded fastener extends through said second hole into said female threads of said shaft on said bottom plate so that said top plate is rotatably connected to said bottom plate.

7. The apparatus of claim 6, further comprising first ball bearings being centrally disposed on said shaft, wherein said bottom plate serves as a race for said first ball bearings so that said top plate is rotatably disposed on said shaft of said bottom plate.

8. The apparatus of claim 7, further comprising a second set of ball bearings disposed between said shaft and said peripheral edge of said bottom plate, wherein said second ball bearings roll in a race disposed in said top surface of said bottom plates, wherein said second ball bearings are captured in said race by said bottom surface of said top plate, wherein said second ball bearings provide support between said top plate and said bottom plate.

9. The apparatus of claim 8, wherein said means for locking said top plate, comprises:

a) a first U-shaped housing disposed partially around the outside surface of said top plate, said first housing having a plurality of horizontal pin apertures therein, each of said pin apertures having a magnetized pin slidably disposed therein having a spring thereon each said pin so as to bias each said pin inwardly into said pin aperture;

b) said side wall of said top plate having a plurality of first horizontal apertures therein so that each said first aperture may receive one said pin therein when said first aperture is co-aligned with said pin aperture;

c) said sidewall of said bottom plate having a plurality of second horizontal apertures therein so that each said second aperture may receive one said pin therein when said first aperture is co-aligned with said pin aperture so that said bottom plate is locked to said top plate when said pins co-align with and extend through said first and second apertures; and, d) a second U-shaped housing disposed in a horizontally sliding relationship with said first U-shaped housing so that said second U-shaped housing can slide toward said first U-shaped housing in a first position and away from said first U-shaped housing in a second position, wherein said second U-shaped housing is spring-loaded to be biased toward said first position, wherein said second U-shaped housing comprises a magnetized member having an opposite magnetic polarity to said magnetized pins, so that said pins are repelled into said first and second apertures when said second U-shaped housing is moved to said first position and said pins are spring-biased back into said pin apertures when said second U-shaped housing is moved to said second position to permit the top plate to be locked into a first or second position.

10. The apparatus of claim 9, wherein said means for locking said top plate further comprises at least one pivot stop nub disposed on said top surface of said bottom plate for mating to at least one mating pivot stop nub recess disposed on said bottom surface of said pivot disk to permit the top plate to be locked in first top plate position or said second top plate position.

* * * * *